US006959919B2

(12) United States Patent
Knott, Sr.

(10) Patent No.: US 6,959,919 B2
(45) Date of Patent: Nov. 1, 2005

(54) FENCE STRUCTURE AND ITS METHOD OF INSTALLATION

(76) Inventor: James M. Knott, Sr., 456 Hill St., Whitinsville, MA (US) 01588

( * ) Notice: Subject to any disclaimer, the term of this patent is extended or adjusted under 35 U.S.C. 154(b) by 412 days.

(21) Appl. No.: 10/196,910

(22) Filed: Jul. 17, 2002

(65) Prior Publication Data

US 2004/0232400 A1 Nov. 25, 2004

(51) Int. Cl.[7] ..... E04H 17/16
(52) U.S. Cl. ..... 256/45; 256/48
(58) Field of Search ..... 256/45, 46, 47, 256/1, 32, 33, 48

(56) References Cited

U.S. PATENT DOCUMENTS

| | | | | |
|---|---|---|---|---|
| 2,826,394 A | | 3/1958 | Pinson | |
| 4,081,148 A | * | 3/1978 | Murphy | 256/45 X |
| 4,209,153 A | * | 6/1980 | Vanvlaenderen | 256/45 X |
| 4,576,364 A | | 3/1986 | O'Fearna | |
| 5,180,143 A | | 1/1993 | Brower | |
| 5,184,808 A | | 2/1993 | Vesper | |
| 5,542,649 A | | 8/1996 | Allegaert et al. | |
| 5,553,807 A | | 9/1996 | Lopez | |
| 5,640,817 A | | 6/1997 | Bos | |
| 5,649,690 A | | 7/1997 | Kilmer | |
| 5,730,426 A | | 3/1998 | Tu | |
| 6,010,116 A | | 1/2000 | Knott | |
| 6,076,448 A | * | 6/2000 | Rexroad | 256/45 X |
| 6,158,923 A | | 12/2000 | Wheeler et al. | |
| 6,367,781 B1 | * | 4/2002 | Flynn et al. | 256/45 |
| 2004/0140463 A1 | * | 7/2004 | Garcia et al. | 256/45 |

* cited by examiner

*Primary Examiner*—John R. Cottingham

(57) ABSTRACT

A wire fencing material comprises parallel line and fill wires extending respectively lengthwise and widthwise. The line and fill wires are secured to one another by welding at cross over locations, and at selected locations and between adjacent fill wires, the line wires have segments projecting alternately from opposite sides of the fencing to thereby define sleeves configured and dimensioned to axially receive support posts.

3 Claims, 3 Drawing Sheets

FENCE STRUCTURE AND ITS METHOD OF INSTALLATION

BACKGROUND OF THE INVENTION

1. Field of the Invention

This invention relates to an improved structure and method of installing wire fencing.

2. Description of the Prior Art

The so called "chain-link" fence is by far the most popular fence in current use in the United States. There are, however, significant problems associated with this type of fence. For example, a chain-link fence can be breached to a man-sized hole by simply making two cuts a few feet apart, and then unraveling the wire between the cuts. Also, to install chain-link fencing, installers dig post holes in the substrate, insert the posts, brace them vertically with two braces, and fill around them with concrete. After the concrete is cured, the installers begin the labor-intensive process of hanging the chain-link fencing and fastening it to the posts. This procedure is both time consuming and expensive.

SUMMARY OF THE INVENTION

In accordance with the present invention, the above noted problems are obviated by providing a novel welded wire fencing having integrally formed sleeves configured and dimensioned to axially receive the fence posts prior to the posts being implanted in the substrate. Thus, labor intensive wire hanging and fastening is avoided. The wire fencing and posts can be installed together as an assembled unit, with the wire assisting in the support and alignment of the posts during installation.

These and other features and advantages of the present invention will now be described in greater detail with reference to the accompanying drawings, wherein:

DETAILED DESCRIPTION OF PREFERRED EMBODIMENT

Figure 1:
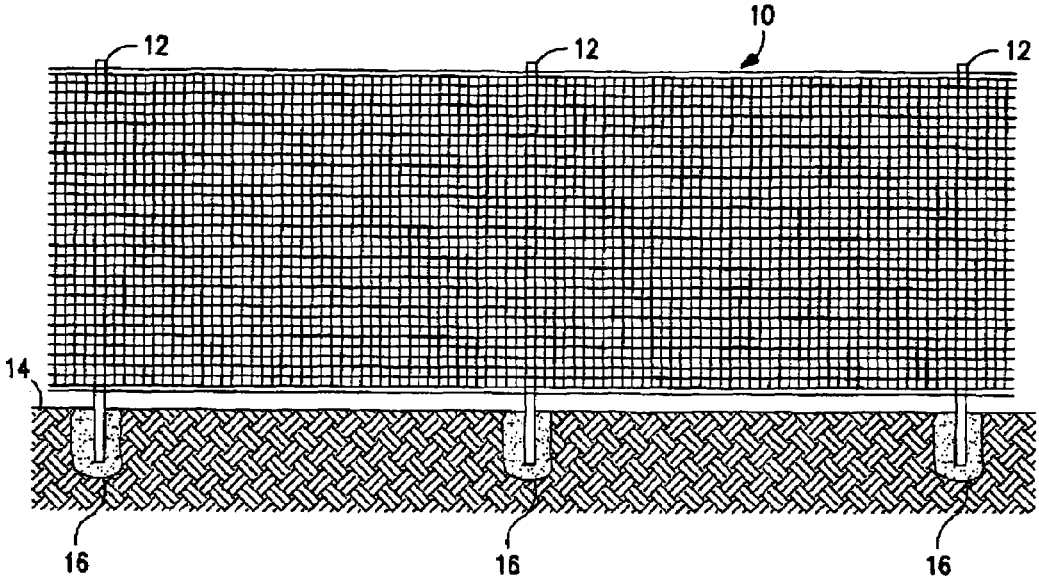
FIG. 1 is a side view of a section of a welded wire fence embodying the concepts of the present invention.
Figure 2:
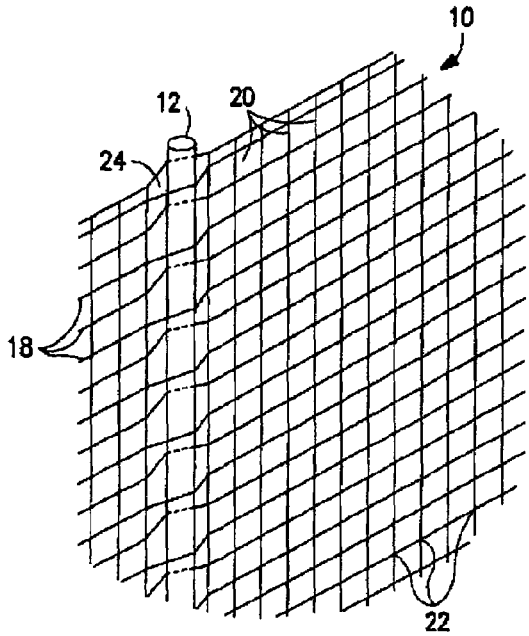
FIG. 2 is an enlarged perspective view of a portion of the fence shown in FIG. 1.

With reference initially to FIGS. 1 and 2, a fence construction in accordance with the present invention includes welded wire fencing 10 supported at spaced intervals by fence posts 12. The lower ends of the fence posts are implanted in a substrate 14 and held rigidly in place by heavy aggregate concrete 16.

The wire fencing includes parallel line and fill wires 18, 20 extending respectively along the length and across the width of the fencing. The fill and line wires are arranged substantially in a common plane, and are secured to one another by welding at cross over locations 22.

Figure 3:
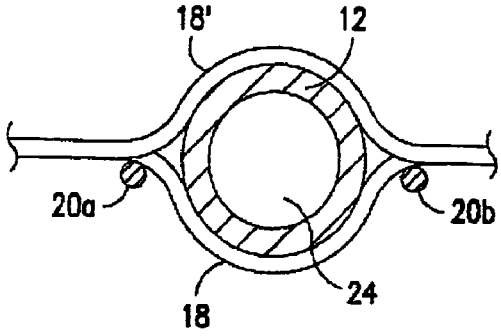
FIG. 3 is an enlarged horizontal sectional view taken through one of the fence posts.

As can best be seen by reference to FIGS. 2 and 3, at selected locations along the fencing and between successive fill wires 20*a*, 20*b*, the line wires 18 have segments 18' that project alternately from opposite sides of the fencing to thereby define sleeves 24 configured and dimensioned to axially receive the fence posts 12.

Figure 4A:
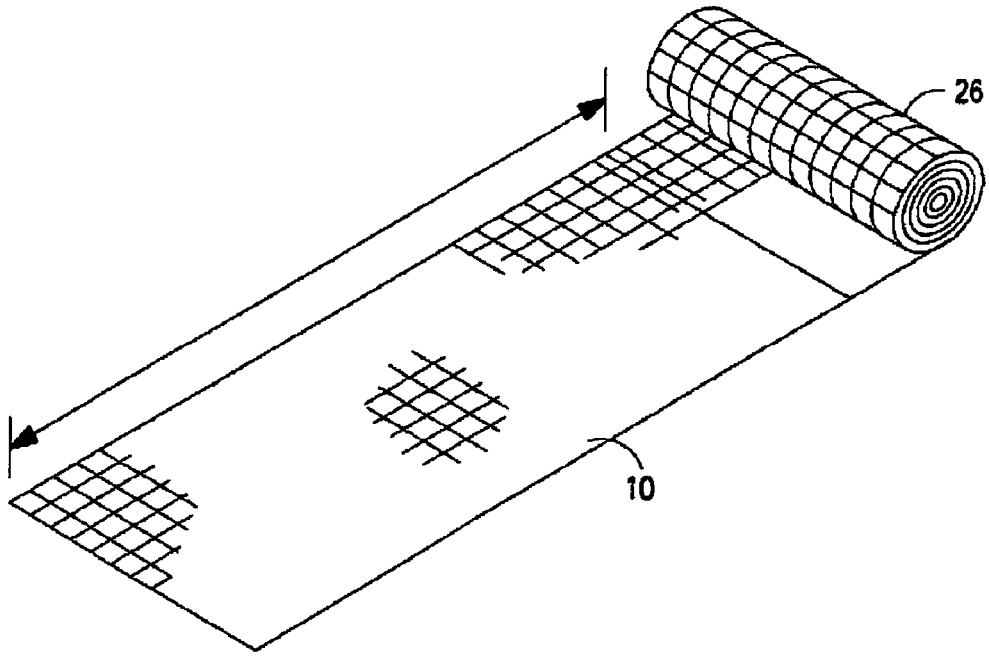
FIGS. 4A–4C are views depicting successive stages in the assembly and installation of the wire fence of the present invention.
Figure 4B:
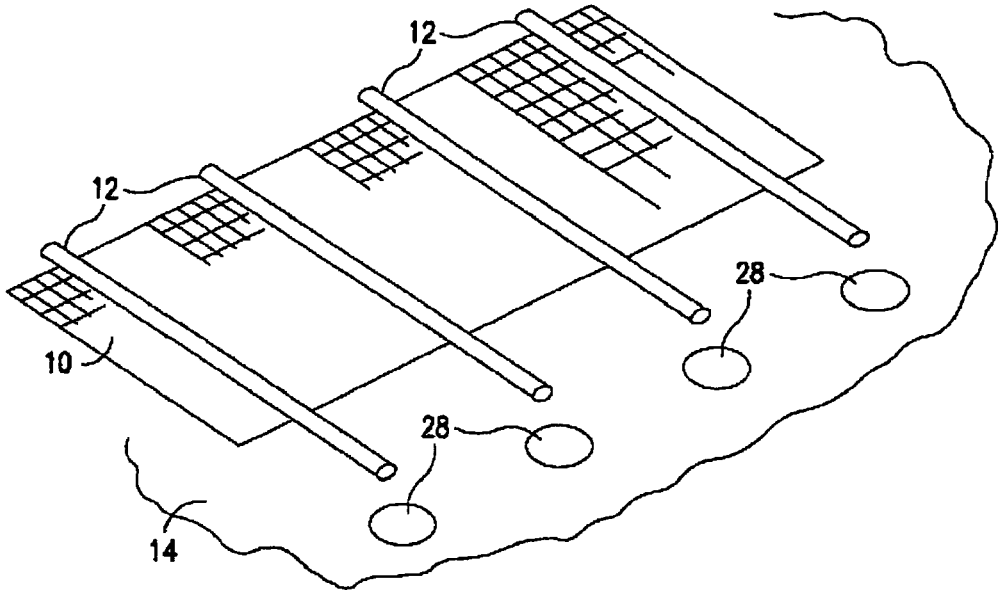
Figure 4C:
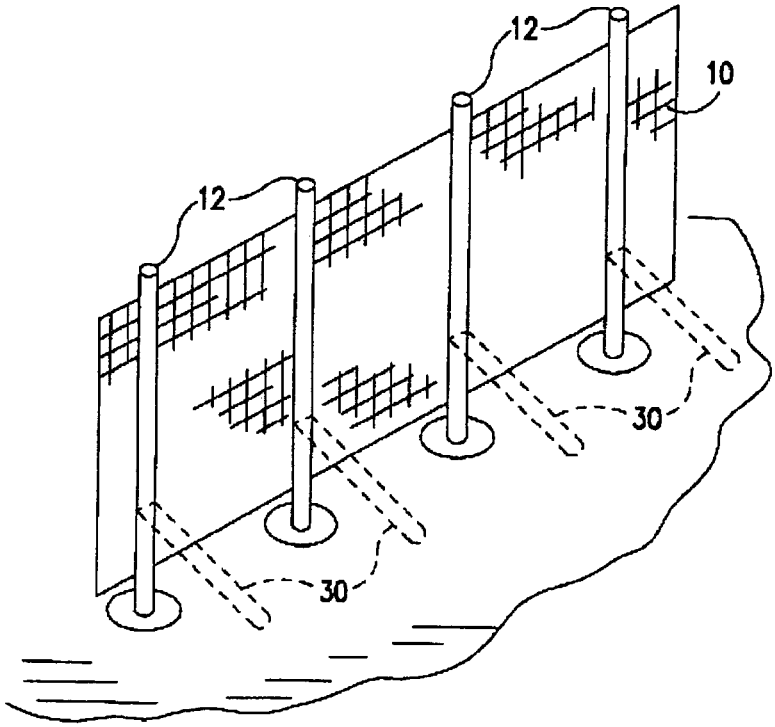

Successive stages in the installation of a fence in accordance with the present invention are illustrated in FIGS. 4A–4C.

With reference to FIG. 4A, it will be understood that the welded wire fencing 10 of the present invention is typically supplied in a roll 26 which can be unwound to a selected length "L" and arranged to overlay the substrate 14.

After separating the selected length from the roll, and as shown in FIG. 4B, the fence posts 12 are inserted in the sleeves 24, with the lower ends of the posts projecting beneath the lower fencing edge. Post holes 28 are then dug in the substrate adjacent the lower ends of the fence posts.

Next, as shown in FIG. 4C, the posts 12 are righted and their projecting lower ends are inserted in the post holes 28. The wire fencing 10 serves to maintain the posts in parallel alignment, and single braces 30 are employed to plumb the entire assembly with respect to the substrate. The holes 28 are then filled with the heavy aggregate concrete 16. The braces 30 may then be removed to complete the installation.

It is to be understood that various modifications and alterations may be made to the above-described embodiment, including for example those relating to the shapes, dimensions and orientation of components and their method of attachment and assembly, without departing from the spirit and scope of the invention as defined by the appended claims.

What is claimed is:

1. Wire fencing comprising:

a single ply wire mesh comprising parallel line wires extending substantially horizontally along a length of said fencing and parallel fill wires extending substantially vertically across the width of said fencing, said line and fill wires being secured to one another by welding at cross over locations; and at selected locations along said mesh and between adjacent fill wires, said line wires have segments projecting alternately from opposite sides of said mesh to thereby define sleeves configured and dimensioned to axially receive support posts.

2. A fence construction comprising the wire fencing of claim 1, and support posts inserted in said sleeves and implanted in a substrate.

3. A method of installing a wire fence comprising:

providing a roll of the wire fencing of claim 1;

unrolling said roll to obtain a selected length of said fencing, said selected length including a plurality of said sleeves;

inserting support posts through said sleeves; and righting and implanting said support posts in a substrate.

* * * * *